US009583886B2

(12) United States Patent
Phillips

(10) Patent No.: US 9,583,886 B2
(45) Date of Patent: Feb. 28, 2017

(54) RECEPTACLE ASSEMBLY WITH GUIDE FRAME

(71) Applicant: Tyco Electronics Corporation, Berwyn, PA (US)

(72) Inventor: Michael John Phillips, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 31 days.

(21) Appl. No.: 14/188,208

(22) Filed: Feb. 24, 2014

(65) Prior Publication Data

US 2015/0244108 A1 Aug. 27, 2015

(51) Int. Cl.
*H01R 13/6581* (2011.01)
*H01R 13/52* (2006.01)
*H01R 13/516* (2006.01)

(52) U.S. Cl.
CPC ..... *H01R 13/6581* (2013.01); *H01R 13/516* (2013.01); *H01R 13/5219* (2013.01)

(58) Field of Classification Search
CPC ..... H01R 13/631; H01R 13/5219; H01R 13/6581; H01R 3/00; H01R 9/00
USPC ..... 439/271, 540.1, 541.5, 607.21, 607.2, 439/374, 297, 298; 361/816, 818
See application file for complete search history.

(56) References Cited

U.S. PATENT DOCUMENTS 5,689,406 A * 11/1997 Wood ..... H05K 7/1429 361/729
6,178,096 B1 1/2001 Flickinger et al.
6,264,499 B1 7/2001 Costello et al.
6,276,963 B1 * 8/2001 Avery ..... H01R 13/65802 439/541.5
6,469,905 B1 * 10/2002 Hwang ..... 361/756
6,473,299 B1 * 10/2002 Worden ..... G06F 1/187 312/223.2
6,600,865 B2 * 7/2003 Hwang ..... H01R 23/6873 361/760
6,661,652 B2 * 12/2003 Worden ..... G06F 1/187 312/223.2
7,423,216 B2 * 9/2008 Pape et al. ..... 174/50
8,098,493 B2 * 1/2012 Ice ..... 361/741
8,444,437 B2 * 5/2013 Szczesny et al. ..... 439/607.17
(Continued)

*Primary Examiner* — Amy Cohen Johnson
*Assistant Examiner* — Milagros Jeancharles

(57) ABSTRACT

A receptacle assembly includes a guide assembly and at least one communication connector. The guide assembly has a guide frame extending from a connector housing. The guide frame includes a front panel and multiple frame members that extend between the front panel and a front wall of the connector housing. The frame members are spatially separated to allow air to flow through the guide frame. The frame members define first and second stacked channels that are each configured to guide a corresponding pluggable module that is received through the front panel through the guide frame to the connector housing. The communication connector is within the connector housing. The communication connector has first and second mating interfaces that extend through respective first and second apertures in the front wall of the connector housing into the first and second channels, respectively, to mate with the corresponding pluggable module within each channel.

19 Claims, 5 Drawing Sheets

(56) References Cited

U.S. PATENT DOCUMENTS

| | | | | |
|---|---|---|---|---|
| 8,449,331 | B2 * | 5/2013 | Phillips | H01R 13/6581 361/704 |
| 8,469,744 | B2 * | 6/2013 | Nichols | H01R 13/518 439/607.01 |
| 8,535,096 | B1 * | 9/2013 | Shirk et al. | 439/607.21 |
| 8,890,004 | B2 * | 11/2014 | Wickes et al. | 174/382 |
| 2004/0203289 | A1 * | 10/2004 | Ice | H05K 9/0058 439/607.2 |
| 2006/0003628 | A1 * | 1/2006 | Long et al. | 439/541.5 |
| 2006/0003632 | A1 * | 1/2006 | Long | H01R 12/716 439/607.2 |
| 2011/0100668 | A1 * | 5/2011 | Syed | G06F 1/18 174/50 |
| 2014/0148050 | A1 * | 5/2014 | Ebisawa | 439/540.1 |

* cited by examiner

RECEPTACLE ASSEMBLY WITH GUIDE FRAME

BACKGROUND OF THE INVENTION

The subject matter described herein relates to a receptacle assembly with a guide frame.

At least some known receptacle assemblies, such as input/output (I/O) connector assemblies, are configured to receive a pluggable module and establish a communicative connection between the pluggable module and an electrical connector of the receptacle assembly. As one example, a known receptacle assembly includes a receptacle housing that is mounted to a circuit board around an electrical connector that is also mounted to the circuit board. The electrical connector may be disposed within an elongated cavity of the receptacle housing that is formed by multiple walls. The receptacle housing may be configured to receive a small form-factor (SFP) pluggable transceiver that is inserted through an opening of the cavity and advanced toward the electrical connector. Thus, when the pluggable transceiver is within the cavity, the walls of the receptacle housing surround both the pluggable transceiver and the electrical connector. The pluggable transceiver and the electrical connector have respective electrical contacts that engage one another to establish a communicative connection.

One challenge often addressed in the design of a receptacle assembly is the handling of excess heat generated by the connectors within the receptacle housing, which may negatively affect electrical performance. As the pluggable transceivers and the electrical connectors convey more data over larger bandwidths, the transceivers and/or electrical connectors typically generate more heat. The heat may not only affect electrical performance but also may damage the connectors if the heat is not drawn away from the receptacle assembly.

Another challenge often addressed in the design of a receptacle assembly is the shielding and/or containment of electromagnetic interference. Electromagnetic interference (EMI) is the disruption of operation of an electronic device due to an electromagnetic field caused by electromagnetic induction and/or radiation emitted by another electronic device. The receptacle assembly may be located in a communication box with many other electronic devices, so EMI from other electronic devices may degrade electrical performance of the receptacle assembly if the receptacle assembly provides insufficient EMI shielding. In addition, EMI from the receptacle assembly may degrade electrical performance of other electronic devices in the communication box if the receptacle assembly does not provide adequate EMI containment.

Receptacle assembly designs often have difficulty providing both heat dissipation and EMI shielding/containment. In the example above, the walls of the receptacle housing that surround the communicative connection between the transceiver and the electrical connector may provide sufficient EMI shielding to support electrical performance of the receptacle assembly, but the walls may also block air flow to and from the connectors to dissipate the heat generated within the connectors. In some cases, the walls of the receptacle housing have openings therethrough that are configured to permit airflow into the cavity to transfer heat to an exterior of the receptacle housing. However, as the number and/or size of the openings in the walls increase to allow more airflow through the receptacle housing, the EMI shielding/containment provided by the receptacle housing decreases as electromagnetic induction and/or radiation can more easily propagate through the openings in the walls with the air. Accordingly, there is a need for a receptacle assembly that provides both EMI shielding along the electrical connectors while also permitting a sufficient amount of airflow to transfer heat away from the receptacle assembly.

BRIEF DESCRIPTION OF THE INVENTION

In an embodiment, a receptacle assembly is provided that includes a guide assembly and at least one communication connector. The guide assembly has a guide frame extending from a connector housing along a mating axis. The guide frame includes a front panel and multiple frame members that extend between the front panel and a front wall of the connector housing. The frame members are spatially separated to allow air to flow through the guide frame. The frame members define first and second channels that are stacked with respect to one another and extend generally parallel to the mating axis. The first and second channels are each configured to guide a corresponding pluggable module that is received through a port opening at the front panel through the guide frame to the connector housing. The at least one communication connector is disposed within the connector housing. The at least one communication connector has a first mating interface and a second mating interface that extend through respective first and second apertures in the front wall of the connector housing into the first and second channels, respectively, to mate with the corresponding pluggable module within each channel.

In an embodiment, a receptacle assembly is provided that includes a guide assembly, at least one communication connector, and at least one gasket. The guide assembly has a guide frame extending from a connector housing along a mating axis. The guide frame includes a front panel and multiple frame members extending between the front panel and a front wall of the connector housing. The frame members define first and second channels that are stacked with respect to one another and extend generally parallel to the mating axis. The first and second channels are each configured to guide a corresponding pluggable module that is received through a port opening at the front panel through the guide frame to the connector housing. The frame members are spatially separated to allow air to flow through the guide frame around a shell of the corresponding pluggable module within each channel. The at least one communication connector is disposed within the connector housing. The at least one communication connector has a first mating interface and a second mating interface that extend through respective first and second apertures in the front wall of the connector housing into the first and second channels, respectively, to mate with the corresponding pluggable module within each channel. The at least one gasket on the front wall of the connector housing surrounds the first and second apertures. The at least one gasket seals the front wall to the shell of the corresponding pluggable module.

In an embodiment, a receptacle assembly is provided that includes a connector portion and a transceiver portion. The connector portion includes at least one communication connector disposed within a cavity of a connector housing. The cavity is at least partially defined by a front wall, a top wall, a back wall, and a pair of opposing side walls of the connector housing to provide electromagnetic interference (EMI) shielding for electrical signals transmitted through the at least one communication connector. The front wall defines first and second apertures that receive respective first and second mating interfaces of the at least one communication connector therethrough. The front wall further includes at least one gasket surrounding the first and second apertures. The transceiver portion extends from the connector portion along a mating axis. The transceiver portion includes a front panel and multiple frame members that couple the front panel to the front wall of the connector portion. The frame members define first and second channels that are stacked with respect to one another and extend generally parallel to the mating axis. The first and second channels are each configured to guide a corresponding transceiver received through a port opening at the front panel through the guide frame to the connector portion to mate with one of the first and second mating interfaces. The frame members are spatially separated to allow air to flow through the guide frame around a shell of the corresponding transceiver. The shell provides EMI shielding for electrical signals transmitted through the corresponding transceiver. The at least one gasket seals the front wall of the connector housing to the shell of the corresponding transceiver and provides EMI shielding for electrical signals transmitted between the at least one communication connector and the corresponding transceiver.

DETAILED DESCRIPTION OF THE INVENTION

Embodiments set forth herein include communication systems and receptacle assemblies.

Figure 1:
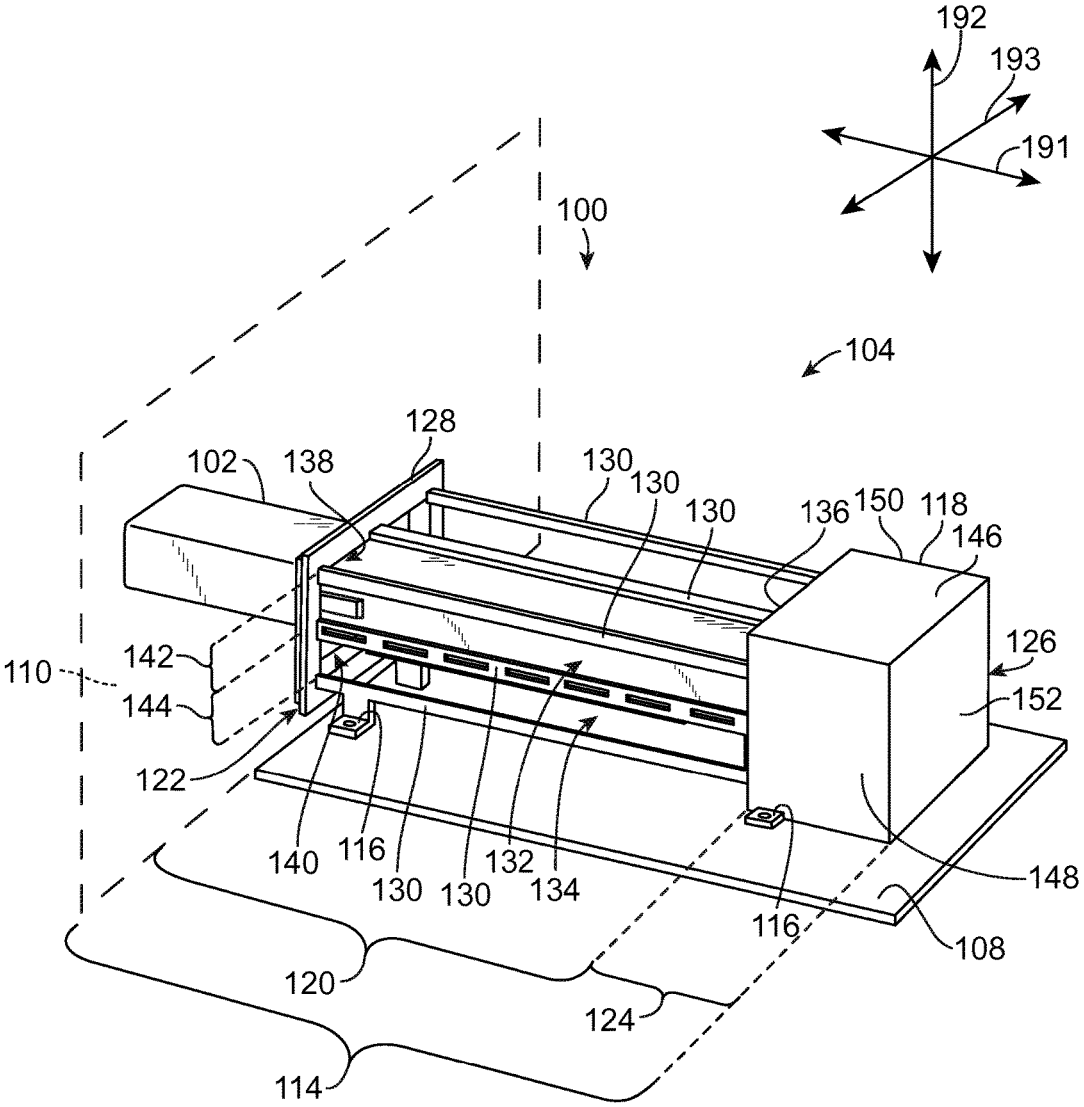
FIG. 1 is a perspective view of a communication system in accordance with an embodiment.

FIG. 1 is a perspective view of a communication system 100 in accordance with an embodiment. The communication system 100 includes one or more pluggable modules 102 and a receptacle assembly 104. The receptacle assembly 104 is configured to provide an open mechanical guide that supports and guides the pluggable module 102 to a mating connection with a communication connector 202 (shown in FIG. 2), such as an electrical connector, within the receptacle assembly 104 while permitting cooling air flow across the pluggable module 102 to dissipate heat. The receptacle assembly 104 is also configured to provide electromagnetic interference (EMI) shielding along an electrical transmission line that extends through the pluggable module 102 and the communication connector 202.

The communication system 100 may include a circuit board 108, the receptacle assembly 104 mounted to the circuit board 108, and the one or more pluggable modules 102 that are configured to communicatively engage the receptacle assembly 104. The communication system 100 is oriented with respect to a mating or insertion axis 191, an elevation axis 192, and a lateral axis 193. The axes 191-193 are mutually perpendicular with respect to one another. Although the elevation axis 192 appears to extend in a vertical direction parallel to gravity in FIG. 1, it is understood that the axes 191-193 are not required to have any particular orientation with respect to gravity. Moreover, only one pluggable module 102 is shown in FIG. 1, but it is understood that multiple pluggable modules 102 may simultaneously engage the receptacle assembly 104.

The communication system 100 may be part of or used with telecommunication systems or devices. For example, the communication system 100 may be part of or include a switch, router, server, hub, network interface card, personal computer, or storage system. The circuit board 108 may be a daughter card or a mother board and include conductive traces (not shown) extending therethrough. The communication system 100 may be disposed at least partially within a communication box or case (not shown) of the telecommunication system or device. For example, the receptacle assembly 104 may be mounted to a panel 110 (e.g., a case panel 110) of the communication case and extend inward of the case panel 110 into the interior of the communication case. The pluggable module 102 may be loaded into the receptacle assembly 104 through an opening in the case panel 110 from a starting position exterior to the communication case. In the illustrated embodiment of FIG. 1, at least a portion of the pluggable module 102 remains external to the communication case when the pluggable module 102 is mated to the receptacle assembly 104.

The pluggable module 102 is an input/output (I/O) module configured to be inserted into and removed from the receptacle assembly 104. The pluggable module 102 may be configured to transmit data signals in the form of electrical signals or optical signals. In other embodiments, the pluggable module 102 may be configured to convert data signals from optical signals to electrical signals or vice-versa. The pluggable module 102 may be referred to herein as a transceiver 102.

The receptacle assembly 104 has a transceiver portion 120 at a front end 122 of the receptacle assembly 104 and a connector portion 124 at a back end 126 of the receptacle assembly 104. The mating axis 191 may extend between the front and back ends 122, 126. Relative or spatial terms such as "front," "back," "top," or "bottom" are only used to distinguish the referenced elements and do not necessarily require particular positions or orientations in the communication system 100 or in the surrounding environment of the communication system 100. For example, the front end 122 may be located in or facing a back portion of the larger communication case (not shown). In one or more applications, the front end 122 may be viewable to a user when the user is inserting the pluggable module 102 into the receptacle assembly 104.

The connector portion 124 of the receptacle assembly 104 includes a connector housing 118 and the communication connector 202 (shown in FIG. 2), which is disposed within the connector housing 118. The transceiver portion 120 of the receptacle assembly 104 is a guide frame, and the transceiver portion 120 may be referred to herein as guide frame 120. The guide frame 120 is coupled to and extends forward from the connector housing 118. The guide frame 120 and connector housing 118 together form a guide assembly 114 that is configured to guide the one or more pluggable modules 102 into mating connection with the at least one communication connector 202 within the connector housing 118. The guide assembly 114 may be mounted to the circuit board 108. For example, the guide assembly 114 may include mounting ears 116 that receive mechanical fasteners (not shown) therethrough that extend into the circuit board 108 and couple the guide assembly 114 to the circuit board 108.

The guide frame 120 may extend along the mating axis 191. The guide frame 120 includes a front panel 128 and multiple frame members 130 that extend between the front panel 128 and a front wall 136 of the connector housing 118. The front panel 128 is configured to interface with the case panel 110 of the communication case (not shown) in which the receptacle assembly 104 is disposed. The frame members 130 are spatially separated from one another and are not interconnected by walls or other structures. As such, the frame members 130 form an open mechanical frame that permits air to flow through the guide frame 120 to transfer heat (or thermal energy) away from the receptacle assembly 104. Although not shown in FIG. 1, the receptacle assembly 104 may be disposed in a communication case that has forced air for cooling the receptacle assembly 104 and other electrical components within the communication case. For example, a cooling fan (not shown) may be positioned near the receptacle assembly 104.

The frame members 130 define first and second channels 132, 134 that are each configured to guide a corresponding pluggable module 102 through the guide frame 120 to the connector housing 118. The first and second channels 132, 134 extend between the front panel 128 and the front wall 136 of the connector housing 118 in a direction that is generally parallel to the mating axis 191. The channels 132, 134 may have the same or similar dimensions. The channels 132, 134 have respective port openings 138, 140 in the front panel 128 that are sized and shaped to each receive a corresponding pluggable module 102. In the illustrated embodiment, the first channel 132 is stacked over the second channel 134 along the elevation axis 192 such that the second channel 134 is positioned between the first channel 132 and the circuit board 108. Optionally, the guide assembly 114 includes a first (or top) row 142 of plural first channels 132 and a second (or bottom) row 144 of plural second channels 134. The rows 142, 144 extend along the lateral axis 193. As shown in FIG. 1, the top row 142 includes two first channels 132 and the bottom row 144 includes two second channels 134 to form a two-by-two guide assembly 114. The guide assembly 114 may have other numbers of channels and/or rows in other embodiments. In alternative embodiments, the guide assembly 114 does not include the stacked channels 132, 134, and, instead, includes only a single row 142 of channels 132 or only a single channel 132.

Figure 2:
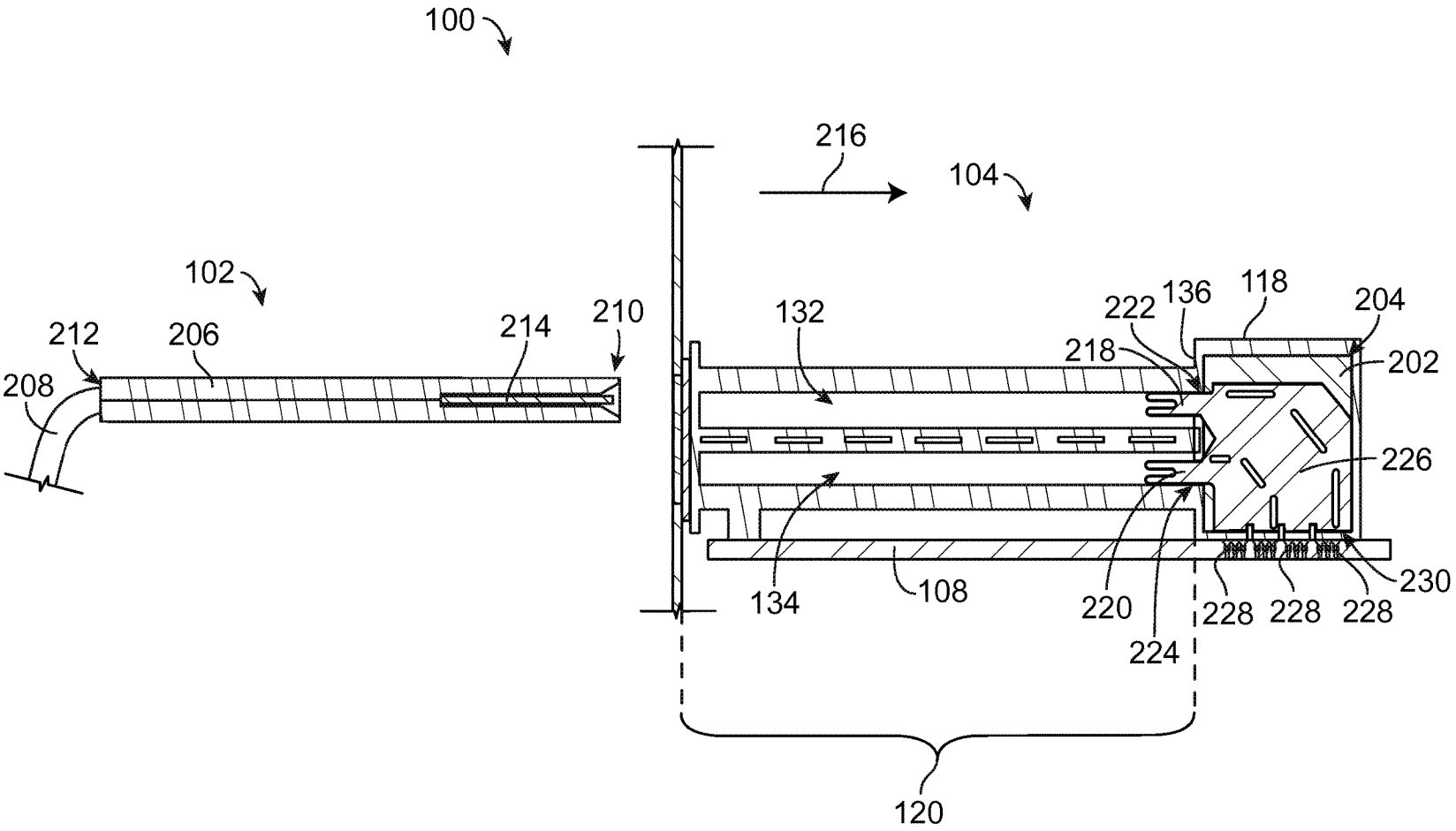
FIG. 2 is a side cross-sectional view of an embodiment of the communication system of FIG. 1 with a pluggable module poised for loading into a receptacle assembly.

The connector housing 118 includes the front wall 136 and multiple other walls that together at least partially define a cavity 204 (shown in FIG. 2) that receives and surrounds the communication connector(s) 202 (shown in FIG. 2). For example, the connector housing 118 may further include a top wall 146, opposing side walls 148, 150, and a back wall 152 opposite the front wall 136. The bottom of the connector housing 118 may be open to allow the communication connector(s) 202 to mount to the circuit board 108 under the connector housing 118. The walls 136, 146 surround the communication connector(s) 202 to provide EMI shielding for electrical signals transmitted through the communication connector(s) 202 within the cavity 204.

As described further below, a communication connector 202 (shown in FIG. 2) within the connector housing 118 is configured to mate with a corresponding pluggable module 102 through an opening in the front wall 136 of the connector housing 118 to provide an electrical connection between the pluggable module 102 and the communication connector 202. The opening in the front wall 136 may be surrounded by a sealing member that seals a mating end of the pluggable module 102 to the front wall 136 to provide EMI shielding at the interface to protect the quality of electrical signals conveyed between the two connectors 102, 202.

FIG. 2 is a side cross-sectional view of an embodiment of the communication system 100 of FIG. 1 with the pluggable module 102 poised for loading into the receptacle assembly 104. The pluggable module 102 may be an input/output cable assembly having a shell 206 and a cable 208. The shell 206 includes a mating end 210 and an opposite cable end 212. The cable 208 is coupled to the shell 206 at the cable end 212. The shell 206 may at least partially surround an internal circuit board 214 that is electrically coupled to electrical wires (not shown) of the cable 208. In alternative embodiments, the cable 208 may include optical fibers (not shown) instead of, or in addition to, electrical wires. Although not shown, the circuit board 214 may include contact pads at or proximate to the mating end 210 of the pluggable module 102. In FIG. 2, the mating end 210 is configured to be inserted into the first channel 132 of the guide frame 120 and advanced in a mating direction 216 along the mating axis 191 (shown in FIG. 1).

The at least one communication connector 202 is disposed within the cavity 204 of the connector housing 118. Only one communication connector 202 is shown in FIG. 2, but it is understood that multiple communication connectors 202 may be located side-by-side along the lateral axis 193 (shown in FIG. 1). The communication connector 202 may be an input/output electrical connector. In the illustrated embodiment, the communication connector 202 has first and second mating interfaces 218, 220. The first mating interface 218 extends through a first aperture 222 in the front wall 136 of the connector housing 118 and is disposed within the first channel 132. The second mating interface 220 extends through a second aperture 224 in the front wall 136 and is disposed within the second channel 134. The first and second mating interfaces 218, 220 are aligned with the first and second port openings 138, 140 (both shown in FIG. 1), respectively. Each of the first and second mating interfaces 218, 220 includes respective electrical contacts 402, 404 (shown in FIG. 4) that are configured to directly engage the internal circuit board 214 of a corresponding pluggable module 102. Thus, a single communication connector 202 may mate with two pluggable modules 102. Alternatively, the mating interfaces 218, 220 may be oriented in a lateral row instead of stacked in a column. In alternative embodiments, the communication connector 202 may have only a single mating interface, and two communication connectors 202 may be stacked along the elevation axis 192 (shown in FIG. 1) in order to provide separate mating interfaces to mate with corresponding pluggable modules 102 in the first and second channels 132, 134.

In an embodiment, the communication connector 202 includes multiple signal planes 226 that are stacked laterally within the communication connector 202, although only one signal plane 226 is shown in the cross-sectional view of FIG. 2. Signal traces (not shown) extend along the signal plane 226 from the mating interfaces 218, 220 to mounting pins or tails 228 at a mounting end 230 of the communication connector 202. The mounting pins 228 are configured to mechanically engage and electrically couple to the circuit board 108 via thru-hole mounting to the circuit board 108, as shown, or via soldering to contact pads (not shown) of the circuit board 108.

In an exemplary embodiment, when each of the first and second mating interfaces 218, 220 are electrically connected to the corresponding pluggable modules 102 upon mating, signal transmission lines (e.g., signal transmission lines 602, 604 shown in FIG. 6) are formed through the receptacle assembly 104 from the cable end 212 of each pluggable module 102 to the mounting end 230 of the communication connector 202. The signal transmission lines define signal pathways for electrical and/or optical signals through the communication system 100. In an exemplary embodiment, the signals are shielded from EMI along the entire transmission lines through the pluggable modules 102 and the receptacle assembly 104. The signal transmission lines may extend beyond the cable end 212 of the pluggable modules 102 along the cable 208, and also beyond the mounting end 230 of the communication connector 202 along conductive traces (not shown) on the circuit board 108.

Figure 3:
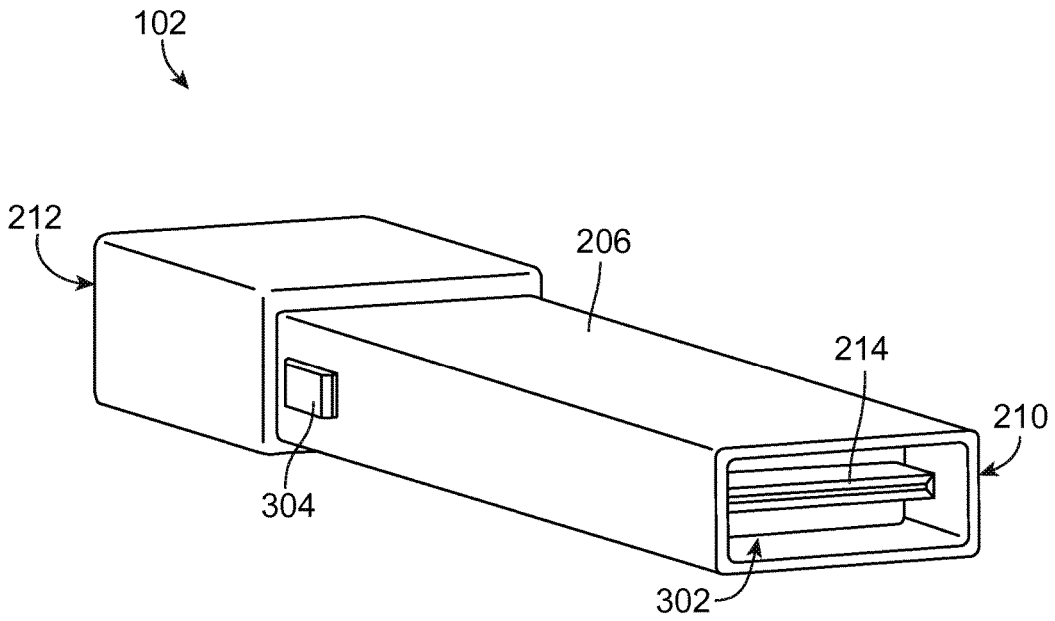
FIG. 3 is a perspective view of a pluggable module formed in accordance with an embodiment that may be used with the communication system of FIG. 1.

FIG. 3 is a perspective view of an embodiment of the pluggable module 102 that may be used with the communication system 100 of FIG. 1. The pluggable module 102 may be a small form-factor pluggable (SFP) transceiver or quad small form-factor pluggable (QSFP) transceiver. The pluggable module 102 may satisfy certain technical specifications for SFP or QSFP transceivers, such as Small-Form Factor (SFF)-8431. In some embodiments, the pluggable module 102 is configured to transmit data signals up to 2.5 gigabits per second (Gbps), up to 5.0 Gbps, up to 10.0 Gbps, or more. By way of example, the receptacle assembly 104 (shown in FIG. 1) and the pluggable module 102 may be similar to the receptacle cages and transceivers, respectively, that are part of the SFP+ product family available from TE Connectivity.

The shell 206 of the pluggable module 102 extends along the length of the pluggable module 102 from the cable end 212 to the mating end 210. One or more latches 304 or other fastening devices may be disposed along the shell 206 to couple the pluggable module 102 to the receptacle assembly 104 (shown in FIG. 1) upon mating and to retain the pluggable module 102 in electrical connection with the communication connector 202 (shown in FIG. 2) of the receptacle assembly 104. The shell 206 may seal to the cable 208 (shown in FIG. 2) at the cable end 212 such that the shell 206 completely encapsulates the internal circuit board 214, wires, fibers, and/or other electrical components within the pluggable module 102, except for a socket opening 302 at the mating end 210. The socket opening 302 is configured to receive one of the mating interfaces 218, 220 (shown in FIG. 2) of the communication connector 202 (shown in FIG. 2) therein. The shell 206 may be formed of an electrically conductive material, such as metal or a polymer having conductive particles. Alternatively, the shell 206 may be formed of a dielectric material, such as polymer without conductive particles, but the pluggable module 102 further includes an electrically conductive shield layer (not shown) disposed between the electronic signal-bearing components and the shell 206 that surrounds the signal-bearing components.

The electrically conductive material of the shell 206 (or the conductive shield layer) provides EMI shielding and containment along the length of the pluggable module 102. Thus, the shell 206 (or the conductive shield layer within the shell 206) provides EMI shielding for signals conveyed through the pluggable module 102 without the need for conductive walls along the guide frame 120 (shown in FIG. 1) of the receptacle assembly 104 (shown in FIG. 1) that surround and block airflow to the pluggable module 102 within the first or second channel 132, 134 (shown in FIG. 1). The material of the shell 206 is thermally conductive to allow heat that is generated within the pluggable module 102 to dissipate through the shell 206. To prohibit EMI leakage at the socket opening 302, which may be the only unshielded portion of the pluggable module 102, the receptacle assembly 104 may have a gasket at the front wall 136 (shown in FIG. 1) of the connector housing 118 (shown in FIG. 1) that is configured to seal to the mating end 210 of the pluggable module 102, as described further herein.

Figure 4:
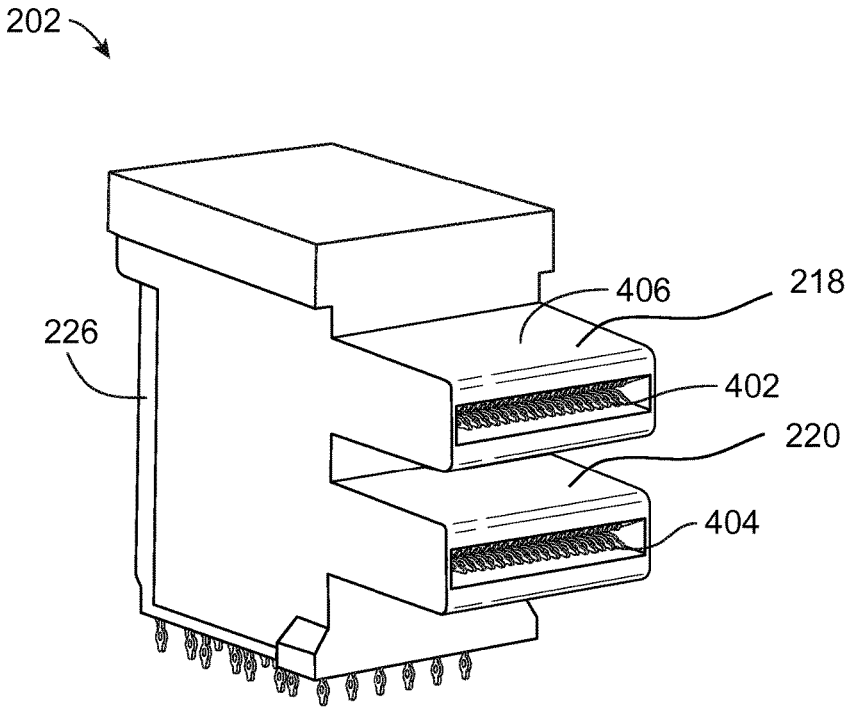
FIG. 4 is a perspective view of a communication connector formed in accordance with an embodiment that may be used with the communication system of FIG. 1.

FIG. 4 is a perspective view of an embodiment of the communication connector 202 that may be used with the communication system 100 of FIG. 1. The communication connector 202 may be a single input/output electrical connector that includes both the first and second mating interfaces 218, 220. The first and second mating interfaces 218, 220 are stacked along the elevation axis 192 (shown in FIG. 1) in order for the first mating interface 218 to align with the first channel 132 (shown in FIG. 2) of the guide frame 120 (shown in FIG. 2) and the second mating interface 220 to align with the second channel 134 (shown in FIG. 2).

Each of the first and second mating interfaces 218, 220 include a plurality of electrical contacts 402, 404, respectively, that electrically couple to the internal circuit board 214 (shown in FIG. 2) or, alternatively, to mating contacts (not shown) of the corresponding pluggable module 102 (shown in FIG. 2). The electrical contacts 402, 404 may be integral with each of the laterally-stacked signal planes 226 of the communication connector 202.

The communication connector 202 may include a dielectric cover 406 that at least partially surrounds and houses the electrical contacts 402, 404 and signal planes 226. The dielectric cover 406 may be formed of a polymer. As described further herein, the communication connector 202 may be shielded from EMI at least partially by the connector housing 118 (shown in FIG. 1), instead of having a conductive shell that provides internal EMI shielding like the pluggable module 102.

Figure 5:
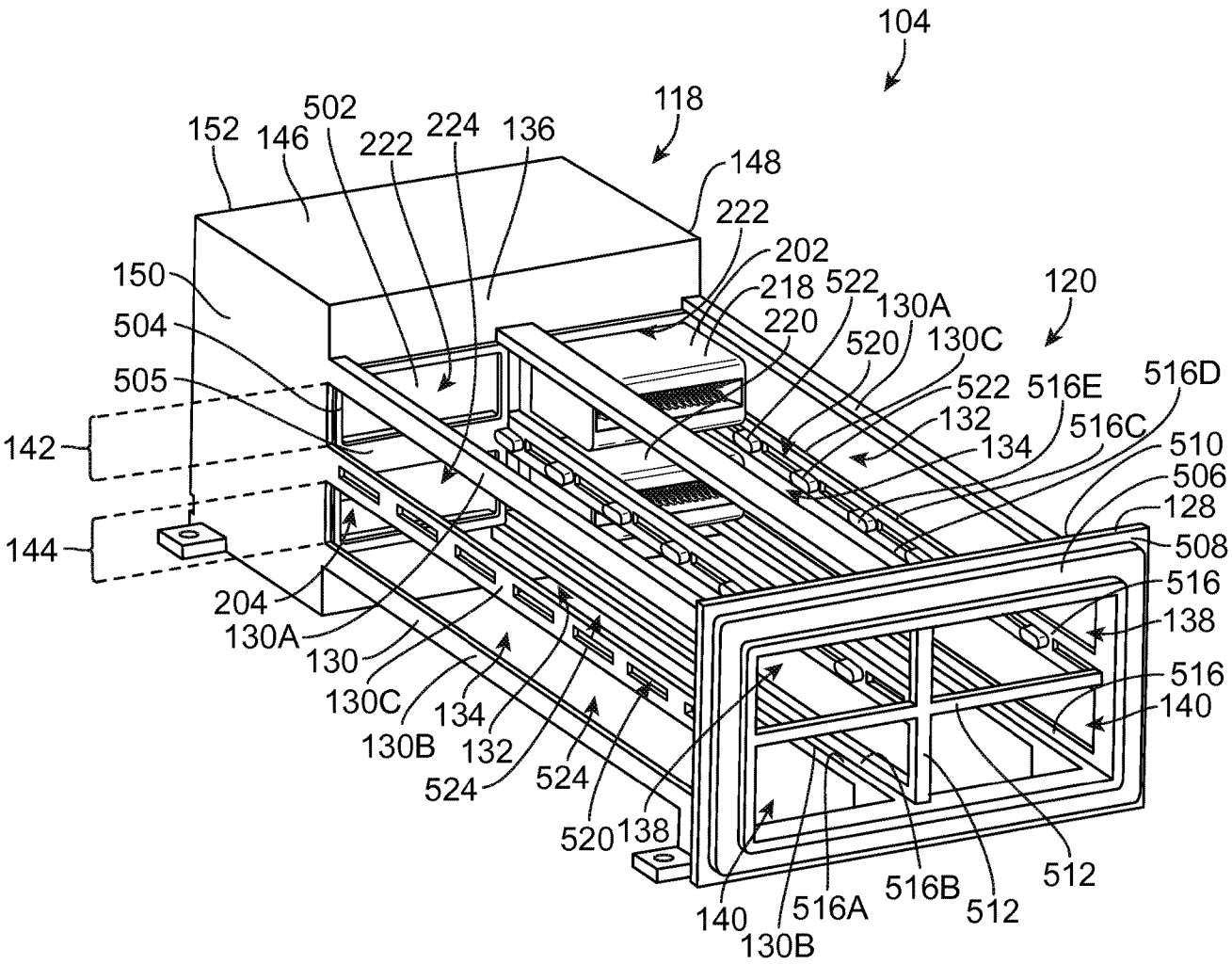
FIG. 5 is a perspective view of a receptacle assembly formed in accordance with an embodiment that may be used with the communication system of FIG. 1.

FIG. 5 is a perspective view of an embodiment of the receptacle assembly 104 that may be used with the communication system 100 of FIG. 1. The receptacle assembly 104 shown in FIG. 5 is configured to receive four pluggable modules 102 (shown in FIG. 1). The frame members 130 of the guide frame 120 define a top row 142 of two first channels 132 and a bottom row 144 of two second channels 134, with each channel 132, 134 configured to receive and guide a corresponding pluggable module 102 to the connector housing 118. The front wall 136 of the connector housing 118 includes four apertures 222, 224 that are each aligned with a corresponding one of the four channels 132, 134. For example, the front wall 136 defines two first apertures 222 disposed side-by-side along the lateral axis 193 (shown in FIG. 1) and two second apertures 224 disposed side-by-side and below the two first apertures 222. The receptacle assembly 104 shown in FIG. 5 includes one communication connector 202 that has a first mating interface 218 extending through one of the first apertures 222 and a second mating interface 220 extending through one of the second apertures 224. The connector housing 118 is configured to house another communication connector 202 that is not shown in FIG. 5.

The walls of the connector housing 118, including the front wall 136, the top wall 146, the side walls 148, 150, and the back wall 152, may be formed of a conductive material, such as metal and/or a polymer having conductive particles. For example, the walls may be stamped and formed from sheet metal. The connector housing 118 may further include one or more partition walls 502 extending along the mating axis 191 (shown in FIG. 1) and coupling the front wall 136 to the back wall 152. The partition walls 502 may be disposed between laterally-adjacent apertures 222, 224 to divide the cavity 204 into individual sections for each communication connector 202. Since the connector housing 118 shown in FIG. 5 is configured to receive two communication connectors 202, a single partition wall 502 is located within the connector housing 118 to split the cavity 204 into two sections. Like the other walls of the connector housing 118, the partition wall 502 may be formed of a conductive material, such as sheet metal.

The conductive walls of the connector housing 118 are configured to provide EMI shielding around each communication connector 202 within the housing 118, although only one communication connector 202 is shown in FIG. 5. For example, the front wall 136, the top wall 146, the side walls 148, 150, and the back wall 152 provide respective shielding in front of, above, on the sides of, and behind the communication connector 202. The connector housing 118 may be mounted on the circuit board 108 (shown in FIG. 1), which may provide EMI shielding below the communication connector 202. In an embodiment, the communication connector 202 may be surrounded on all sides by the connector housing 118 and the circuit board 108, except for the apertures 222, 224 in the front wall 136 through which the respective mating interfaces 218, 220 extend in order to mate with the corresponding pluggable modules 102 (shown in FIG. 1). While the mating interfaces 218, 220 are not shielded by any cage of the connector housing 118, when a corresponding pluggable module 102 is plugged onto the respective mating interface 218, 220, the shell 206 (shown in FIG. 3) of the pluggable module 102 provides shielding for the signal transmission line along the mating interface 218, 220.

In an embodiment, a gasket 504 is disposed on the outer surface of the front wall 136 surrounding one or both of the first and second apertures 222, 224. The gasket 504 may be a single integral piece that surrounds both of the apertures 222, 224, such that the gasket 504 has a figure-eight shape with an outer border and a cross-bar 505 that extends along the front wall 136 between the first and second apertures 222, 224. Alternatively, the gasket 504 may surround only the first aperture 222 or only the second aperture 224. In an alternative embodiment, the gasket 504 may comprise two separate pieces each surrounding a respective one of the first and second apertures 222, 224. The gasket 504 is configured to seal the front wall 136 to the mating end 210 (shown in FIG. 2) of the corresponding pluggable module 102 (shown in FIG. 2) that is mated to one of the first and second mating interfaces 218, 220. The gasket 504 may be formed of an elastomeric material to provide a compression seal when contacted by the mating end 210 of the pluggable module 102. The gasket 504 also may be formed of a conductive material to provide EMI shielding at the interface between the pluggable module 102 and the communication connector 202 to support the quality of electrical signals conveyed therethrough.

In an embodiment, the gasket 504 on the front wall 136 is a first gasket 504, and the receptacle assembly 104 includes a second gasket 506 disposed on the front panel 128. The second gasket 506 may be disposed on a front surface 508 of the front panel 128 which is opposite to a back surface 510 where the frame members 130 couple to the front panel 128. In the illustrated embodiment, the second gasket 506 may have a rectangular or elliptic shape and collectively surrounds all of the port openings 138, 140 in the front panel 128. In an alternative embodiment, the second gasket 506 may include vertical or horizontal cross-bars that cover beams 512 of the front panel 128 that partition the individual port openings 138, 140. In this alternative embodiment, the second gasket 506 surrounds the port openings 138, 140 individually instead of collectively. The second gasket 506 may be formed of a conductive elastomeric material.

The second gasket 506 is configured to seal to an interior surface of the case panel 110 (shown in FIG. 1) of a communication case (not shown) in which the receptacle assembly 104 is disposed. Since the pluggable modules 102 (shown in FIG. 1) are configured to be inserted into the receptacle assembly 104 from outside of the communication case through an opening (not shown) in the case panel 110, the second gasket 506 is configured to provide EMI shielding around the opening of the case panel 110. As such, the second gasket 506 contains electromagnetic radiation that is produced within the communication case (e.g., by the receptacle assembly 104 or other electrical devices) within the box to prohibit the radiation from propagating through the opening in the case panel 110. In addition, the second gasket 506 blocks electromagnetic radiation produced external to the communication case from entering the communication case through the opening in the case panel 110 between the guide frame 120 and the panel 110. Although not shown, a third gasket may be disposed on the case panel 110 and/or on the shells 206 of the pluggable modules 102 to allow the pluggable modules 102 to seal to the panel 110 upon insertion into the receptacle assembly 104 to provide further EMI shielding. For example, the third gasket may prohibit electromagnetic radiation from entering and/or exiting the communication case through the port openings 138, 140 of the guide frame 120 and the opening of the case panel 110.

The frame members 130 of the guide frame 120 may be formed of a conductive material, such as metal. The frame members 130 include upper frame members 130A, lower frame members 130B, and mid frame members 130C that are axially disposed between the upper frame members 130A and the lower frame members 130B along the elevation axis 192 (shown in FIG. 1). The upper frame members 130A define an upper edge of the first channel 132. The lower frame members 130B define a lower edge of the second channel 134. The mid frame members 130C are disposed between the first and second channels 132, 134. Each mid frame member 130C may be configured to define both a lower edge of the first channel 132 and an upper edge of the second channel 134. Alternatively, some mid frame members 130C define the lower edge of the first channel 132 and other mid frame members 130C define the upper edge of the second channel 134.

The frame members 130 each include at least one rail 516 that is configured to guide the corresponding pluggable module 102 (shown in FIG. 1) within one of the first and second channels 132, 134 by restricting movement of the pluggable module 102 in a vertical and/or lateral direction. For example, as shown in FIG. 5, the lower frame members 130B each include a first rail 516A that provides a base for the corresponding pluggable module 102 to slide towards the connector housing 118, restricting movement of the pluggable module 102 in the vertical direction towards the circuit board 108 (shown in FIG. 1). The lower frame members 130B also include a second rail 516B that provides a shelf that extends generally orthogonally to the first rail 516A. The second rail 516B restricts lateral movement of the corresponding pluggable module 102 as the pluggable module 102 is loaded towards the connector housing 118. In the illustrated embodiment, the mid frame members 130C each include at least three rails 516, with a first rail 516C restricting lateral movement of a corresponding pluggable module 102 within the first channel 132, a second, opposite rail 516D restricting lateral movement of a corresponding pluggable module 102 within the second channel 134, and a third rail 516E that extends generally orthogonally to the first and second rails 516C, 516D and restricts vertical movement of the pluggable modules 102 in the first and second channels 132, 134 toward each other. The rails 516 in each channel 132, 134 together form a track for the corresponding pluggable modules 102 from the front panel 128 to the connector housing 118 for mating to respective mating interfaces 218, 220.

In an embodiment, the frame members 130 of the guide frame 120 are spatially separated by large windows or gaps 524 to allow air to flow around the corresponding pluggable modules 102 (shown in FIG. 1) within the first and second channels 132, 134. Thermal energy (e.g., heat) generated within the pluggable modules 102 may be transferred to the air stream flowing through the guide frame 120 such that the heat is dissipated away from the pluggable modules 102 and receptacle assembly 104. To reduce any obstructions to the flow of air through the guide frame 120, the frame members 130 are not interconnected by any beams, panels, or the like. Therefore, the guide frame 120 permits air to flow between adjacent frame members 130 and around and/or along a significant surface area of each of the shells 206 (shown in FIG. 2) of the pluggable modules 102. For example, a majority of the shells 206 may be exposed through the gaps 524. Optionally, greater than 90% of the shell 206 may be exposed through the gaps 524. Since a significant amount of air flow is allowed to the pluggable modules 102, the air absorbs and dissipates a significant amount of heat.

To further reduce obstructions to air flow, at least some of the frame members may define slots 520 therethrough to allow air to flow through the frame members 130, instead of only through the windows or gaps 524 formed between adjacent frame members 130. For example, in the illustrated embodiment, the mid frame members 130C define slots 520. The slots 520 extend through the frame members 130C and segment the third rail 516E into plural disconnected lugs 522. However, the disconnected lugs 522 of the third rail 516E provide similar functionality to a continuous rail. For example, the edges of the lugs 522 may be curved to support a smooth ingress and egress of the pluggable modules 102 (shown in FIG. 1) through the respective channels 132, 134. The slots 520 in the mid frame members 130C permit air to flow between the pluggable module 102 in the first channel 132 and the pluggable module 102 in the second channel 134. Such air pathway between the channels 132, 134 would have been blocked or at least obstructed by the frame member 130C if the frame member 130C did not include the slots 520.

In a further effort to reduce obstructions to air flow, in an exemplary embodiment, the frame members 130 are relatively thin and no more than four frame members 130 define each of the first and second channels 132, 134. For example, as shown in FIG. 5, the first channel 132 is defined by two upper frame members 130A and two mid frame members 130C, and the second channel 134 is defined by two mid frame members 130C and two lower frame members 130B. Thus, each channel 132, 134 is defined by four frame members, but since the two mid frame members 130C play a dual role in defining both channels 132, 134, only six total frame members 130 are used to define the first and second channels 132, 134. In addition, for the guide frame 120 that includes rows 142, 144 of multiple channels 132, 134, such as in FIG. 5, some frame members 130 between laterally-adjacent channels may be used to define both channels. In FIG. 5, there are four total channels 132, 134, but only nine total frame members 130 define the edges of the four channels 132, 134. By limiting the total number of frame members 130 within the guide frame 120, obstructions to air flow through the guide frame 120 are reduced.

Figure 6:
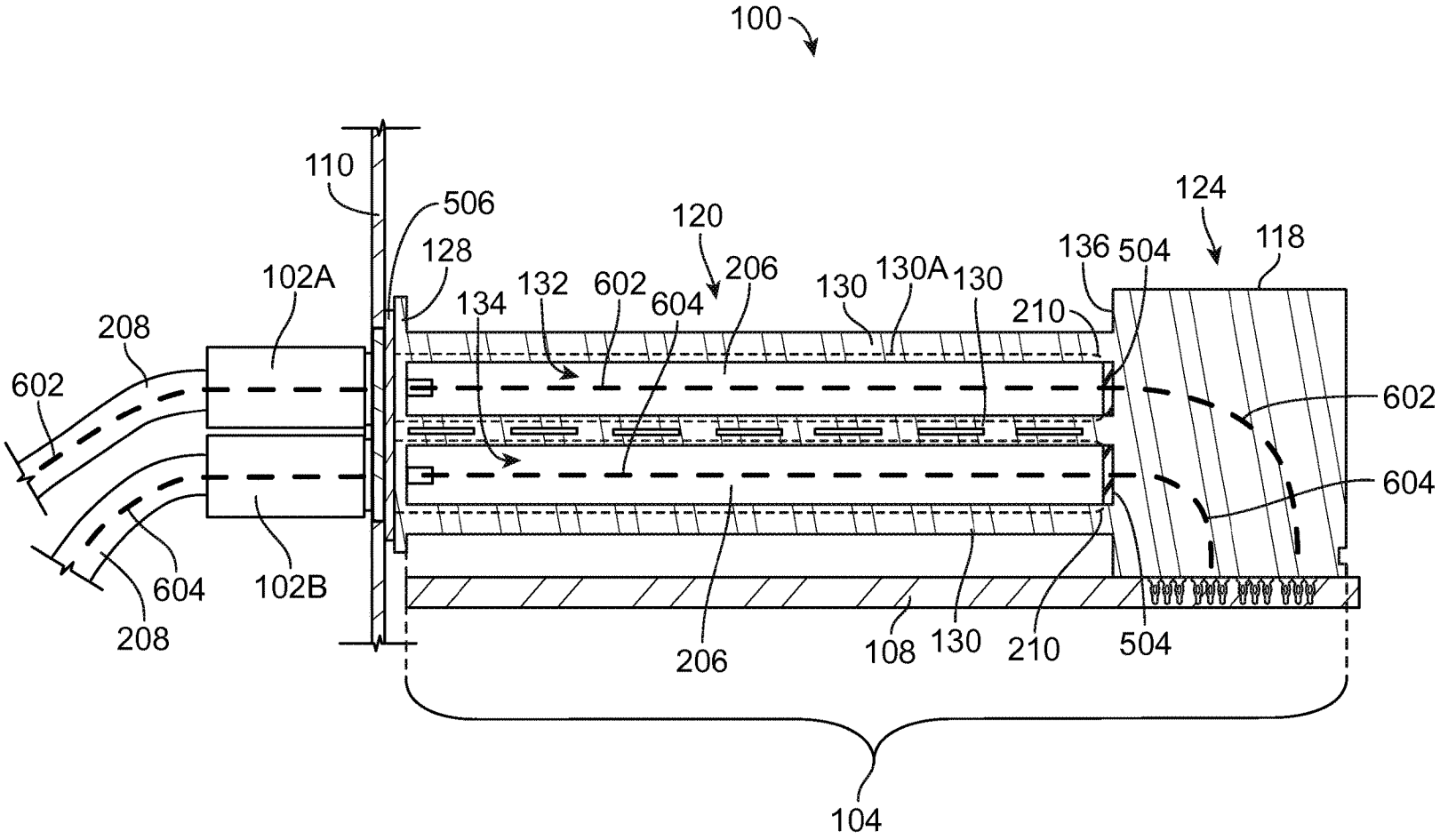
FIG. 6 is a side view of the communication system of FIG. 1 in accordance with an embodiment.

FIG. 6 is a side view of the communication system 100 of FIG. 1 in accordance with an embodiment. A first pluggable module 102A is loaded into the first channel 132 of the guide frame 120 or transceiver portion 120 and mated to a first mating interface 218 (shown in FIG. 2) of a communication connector 202 (shown in FIG. 2). A second pluggable module 102B is loaded into the second channel 134 below the first module 102A and mated to a second mating interface 220 (shown in FIG. 2) of the communication connector 202. The outlines of the shells 206 of the two pluggable modules 102 that are behind the frame members 130 are shown in FIG. 6 as dashed lines. When the pluggable modules 102A, 102B are mated and electrically connected to the respective first and second mating interfaces 218, 220, corresponding first and second signal transmission lines 602, 604 are formed. The signal transmission lines 602, 604 may define signal pathways for electrical signals conveyed between the pluggable modules 102A, 102B and the at least one communication connector 202 within the connector housing 118. Optionally, optical signals may be conveyed along at least part of the signal transmission line 602. For example, optical signals may be conveyed through the cable 208 and into the pluggable module 102A, which converts the optical signals to electrical signals for transfer to the electrical communication connector 202. Beyond the communication connector 202, the signals may be transmitted along circuit traces (not shown) on the circuit board 108 to other electrical devices and/or components.

In an exemplary embodiment, the transceiver portion 120 of the receptacle assembly 104 includes shell shields in the form of the shells 206 of the pluggable modules 102A, 102B. The shells 206 provide EMI shielding for signals conveyed along the respective transmission lines 602, 604 through the lengths of the pluggable modules 102A, 102B. In addition, the connector portion 124 of the receptacle assembly 104 includes wall shields in the form of the cage of the connector housing 118. The connector housing 118 is configured to provide EMI shielding for the signals conveyed along the transmission lines 602, 604 through the communication connector 202 (shown in FIG. 2) within the connector housing 118. The gasket 504 provides EMI shielding at the interface between the transceiver portion 120 and the connector portion 124 such that the entire length of the transmission lines 602, 604 through the receptacle assembly 104 are shielded.

As described above, the socket openings 302 (shown in FIG. 3) of the pluggable modules 102A, 102B and the apertures 222, 224 (shown in FIG. 2) of the connector housing 118 are potential unshielded areas that may allow electromagnetic radiation and/or induction to disrupt the signals conveyed through the transmission lines 602, 604. However, the mating ends 210 of the pluggable modules 102A, 102B each seal to the gasket 504 along the front wall 136 of the connector housing 118 around the apertures 222, 224 (e.g., and around the mating interfaces 218, 220 (FIG. 2) extending therethrough). The gasket 504 seals the pluggable modules 102A, 102B to the connector housing 118 to provide EMI shielding and containment at the interface between the modules 102A, 102B and the at least one communication connector 202. In addition, the second gasket 506 at the front panel 128 of the receptacle assembly 104 seals the front panel 128 to the case panel 110 of the communication case (not shown) to provide EMI shielding around the opening (not shown) of the panel 110, through which the pluggable modules 102A, 102B are inserted. As a result, the signals conveyed along the transmission lines 602, 604 may be shielded from EMI along an entire length of the pluggable modules 102A, 102B and receptacle assembly 104 from the cables 208 to the circuit board 108.

In addition to providing EMI shielding, the receptacle assembly 104 has an open guide frame 120 that provides little obstruction to the flow of air between and around the shells 206 of the pluggable modules 102A, 102B to dissipate heat that is generated during operation of the communication system 100. Thus, the pluggable modules 102A, 102E and other electrical components, such as the at least one communication connector 202 (shown in FIG. 2), may be cooled by the air and protected from overheating. The signals transmitted along the transmission lines 602, 604 may be protected from signal degradation caused by excess heat in the electrical components. Optionally, if further cooling is desired, a heat sink (not shown) may be coupled to the guide frame 120. For example, the heat sink may be coupled to one or more of the upper frame members 103A and disposed above the guide frame 120 along the elevation axis 192 (shown in FIG. 1). The heat sink may be configured to transfer heat generated within the pluggable modules 102A, 102B away from the receptacle assembly 104.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A receptacle assembly comprising:

a guide assembly having a guide frame extending from a connector housing along a mating axis, the connector housing having electrically conductive walls including a front wall, the guide frame including a front panel and multiple frame members extending between the front panel and the front wall of the connector housing, the frame members defining a top channel and a bottom channel that are stacked with respect to one another along an elevation axis and extend generally parallel to the mating axis, the top channel and the bottom channel each configured to receive a corresponding pluggable module through a port opening at the front panel and guide the corresponding pluggable module toward the connector housing, the frame members including upper frame members, lower frame members, and mid frame members that are disposed between the upper frame members and the lower frame members, wherein the upper frame members and the mid frame members define the top channel, and the lower frame members and the mid frame members define the bottom channel, the mid frame members being spatially separated by gaps from the upper frame members and the lower frame members such that air can flow through the gaps into and out of the top channel and the bottom channel; and at least one communication connector disposed within the connector housing, the at least one communication connector having a first mating interface and a second mating interface that extend through respective first and second apertures in the front wall of the connector housing into the top and bottom channels, respectively, to mate with the corresponding pluggable module within each of the top and bottom channels.

2. The receptacle assembly of claim 1, further including a gasket on the front wall of the connector housing surrounding the first and second apertures, the gasket sealing the front wall to a mating end of the corresponding pluggable module.

3. The receptacle assembly of claim 2, wherein the gasket is formed of a conductive material to provide electromagnetic interference (EMI) shielding for electrical signals transmitted between the corresponding pluggable module and the at least one communication connector.

4. The receptacle assembly of claim 1, wherein the electrically conductive walls of the connector housing further include a top wall, opposing side walls, and a back wall opposite the front wall that together at least partially define a cavity that receives the at least one communication connector, the walls providing electromagnetic interference (EMI) shielding for electrical signals transmitted through the at least one communication connector within the cavity.

5. The receptacle assembly of claim 1, further comprising a first gasket on the front wall of the connector housing surrounding the first and second apertures and a second gasket on the front panel of the guide frame surrounding the port opening, the second gasket configured to seal the front panel to a case panel of a communication case and to provide electromagnetic interference (EMI) containment between the front panel and the case panel.

6. The receptacle assembly of claim 1, further comprising a circuit board, the guide assembly and the at least one communication connector being mounted to the circuit board.

7. The receptacle assembly of claim 1, wherein one or more of the frame members define slots therethrough to allow air to flow unobstructed through the guide frame around the corresponding pluggable module.

8. The receptacle assembly of claim 1, wherein each of the frame members includes at least one horizontal rail and at least one vertical rail, the horizontal rails of the upper frame members defining an upper edge of the top channel configured to engage a top of the corresponding pluggable module received in the top channel, the horizontal rails of the lower frame members defining a lower edge of the bottom channel configured to engage a bottom of the corresponding pluggable module received in the bottom channel, the mid frame members defining a lower edge of the top channel and an upper edge of the bottom channel.

9. A receptacle assembly comprising:

a guide assembly having a guide frame extending from a connector housing along a mating axis, the connector housing having electrically conductive walls including a front wall, the guide frame including a front panel and multiple frame members extending between the front panel and the front wall of the connector housing, the frame members defining top channels and bottom channels that extend generally parallel to the mating axis, each of the top channels being stacked over a respective one of the bottom channels, each of the top channels and the bottom channels being configured to receive a corresponding pluggable module through a port opening at the front panel and guide the corresponding pluggable module toward the connector housing, the frame members including upper frame members, lower frame members, and mid frame members that are disposed between the upper frame members and the lower frame members, wherein the upper frame members and the mid frame members define the top channels, and the lower frame members and the mid frame members define the bottom channels, the upper frame members, the mid frame members and the lower frame members being spatially separated from each other by gaps such that a majority of a surface area of the corresponding pluggable module is exposed through the gaps; and at least one communication connector disposed within the connector housing, the at least one communication connector having a first mating interface and a second mating interface that extend through respective first and second apertures in the front wall of the connector housing into one of the top channels and one of the bottom channels, respectively, to mate with the corresponding pluggable module within the one top channel and the one bottom channel.

10. The receptacle assembly of claim 9, wherein the electrically conductive walls of the connector housing further include a top wall, opposing side walls, and a back wall opposite the front wall that together at least partially define a cavity that receives the at least one communication connector, the walls providing electromagnetic interference (EMI) shielding for electrical signals transmitted through the at least one communication connector within the cavity.

11. The receptacle assembly of claim 9, wherein one or more of the frame members define slots therethrough to allow air to flow unobstructed through the guide frame around the corresponding pluggable module.

12. The receptacle assembly of claim 9, further comprising a gasket on the front wall of the connector housing surrounding the first and second apertures, the gasket sealing the front wall to the shell of the corresponding pluggable module.

13. The receptacle assembly of claim 12, wherein the gasket is a first gasket and the front panel of the guide frame includes a second gasket that surrounds the port opening, the second gasket configured to seal the front panel to a case panel of a communication case and to provide electromagnetic interference (EMI) shielding between the front panel and the case panel.

14. The receptacle assembly of claim 9, wherein each of the frame members includes at least one horizontal rail and at least one vertical rail, the horizontal rails of the upper frame members defining an upper edge of the top channels configured to engage a top of the corresponding pluggable modules received in the top channels, the horizontal rails of the lower frame members defining a lower edge of the bottom channels configured to engage a bottom of the corresponding pluggable modules received in the bottom channels, the mid frame members defining a lower edge of the top channels and an upper edge of the bottom channels.

15. A receptacle assembly comprising:

a connector portion that includes at least one communication connector disposed within a cavity of a connector housing, the cavity at least partially defined by electrically conductive walls of the connector housing that include a front wall, a top wall, a back wall, and a pair of opposing side walls of the connector housing to provide electromagnetic interference (EMI) shielding for electrical signals transmitted through the at least one communication connector, the front wall defining first and second apertures that receive respective first and second mating interfaces of the at least one communication connector therethrough, the front wall further including an electrically conductive gasket surrounding the first and second apertures; and a transceiver portion extending from the connector portion along a mating axis, the transceiver portion including a front panel and multiple frame members that couple the front panel to the front wall of the connector housing, the frame members defining top and bottom channels that are stacked with respect to one another along an elevation axis and both extend generally parallel to the mating axis, the top and bottom channels each configured to guide a corresponding transceiver received through a port opening at the front panel through the transceiver portion to the connector portion to mate with one of the first and second mating interfaces, the frame members including upper frame members, lower frame members, and mid frame members that are disposed between the upper and lower frame members along the elevation axis, each frame member including at least one horizontal rail and at least one vertical rail, the horizontal rails of the upper frame members defining an upper edge of the top channel configured to engage a top of the corresponding transceiver received in the top channel, the horizontal rails of the lower frame members defining a lower edge of the bottom channel configured to engage a bottom of the corresponding transceiver received in the bottom channel, the mid frame members defining a lower edge of the top channel and an upper edge of the bottom channel, the frame members being spatially separated from one another such that the frame members are not interconnected to allow air to flow through the transceiver portion around shells of the corresponding transceivers, the shells providing EMI shielding for electrical signals transmitted through the corresponding transceivers;

wherein the gasket seals the front wall of the connector housing to the shells of the corresponding transceivers and provides EMI shielding for electrical signals transmitted between the at least one communication connector and the corresponding transceivers.

16. The receptacle assembly of claim 15, wherein each of the top and bottom channels of the transceiver portion is defined by four frame members.

17. The receptacle assembly of claim 15, further comprising a circuit board, the connector portion and the transceiver portion being mounted to the circuit board.

18. The receptacle assembly of claim 15, wherein the mid frame members each include an upper vertical rail, a lower vertical rail, and a horizontal rail extending orthogonal relative to the upper and lower vertical rails, a top surface of the horizontal rail defining the lower edge of the top channel, a bottom surface of the horizontal rail defining the upper edge of the bottom channel such that each mid frame member defines portions of both the top channel and the bottom channel.

19. The receptacle assembly of claim 18, wherein the mid frame members define slots that extend horizontally through the mid frame members, the slots segmenting the horizontal rail of each respective mid frame member into plural disconnected lugs along the length of the mid frame member, the slots allowing air to flow between the corresponding transceiver received in the top channel and the corresponding transceiver received in the bottom channel.

* * * * *